US005446483A

United States Patent [19]

Duley

[11] Patent Number: 5,446,483

[45] Date of Patent: Aug. 29, 1995

[54] VARIABLE SPEED CONTROLLER FOR AN ELECTRONIC DISPLAY

[75] Inventor: Raymond S. Duley, Buda, Tex.

[73] Assignee: Advanced Micro Devices, Inc., Sunnyvale, Calif.

[21] Appl. No.: 49,975

[22] Filed: Apr. 19, 1993

[51] Int. Cl.[6] ..... G09G 3/00

[52] U.S. Cl. ..... 345/212; 348/686; 348/687

[58] Field of Search ..... 345/212, 211; 358/168; 348/687, 686

[56] References Cited

U.S. PATENT DOCUMENTS

| | | | |
|---|---|---|---|
| 4,065,681 | 12/1977 | Beyers, Jr. | 358/168 |
| 4,800,433 | 1/1989 | Kamemoto | 358/168 |
| 4,982,287 | 1/1991 | Lagoni | 358/168 |
| 5,264,934 | 11/1993 | Nakagawa | 358/168 |

FOREIGN PATENT DOCUMENTS 04069697 3/1992 Japan .

OTHER PUBLICATIONS

Hortensius, et al., "Digital Contrast and Brightness Controls for a Liquid Crystal Display", *IBM Technical Disclosure Bulletin*, vol. 36, No. 10 (Oct. 1993), pp. 395–397.

*Primary Examiner*—Ulysses Weldon
*Assistant Examiner*—Matthew Luu
*Attorney, Agent, or Firm*—Conley, Rose & Tayon

[57] ABSTRACT

An electronic display and electronic display controller is provided for quickly and precisely adjusting visibility parameters of an object being displayed. The electronic display controller includes a clocking circuit capable of producing varying frequency clocking pulses which can be received by a potentiometer to incrementally adjust the visibility of a displayed object. Activation of one or more buttons on the external housing of the display will cause low frequency clocking signals to be sent to the potentiometer and, after a set period of time, higher frequency clocking signals can be sent provided the button remains active. Initial low frequency and subsequent high frequency clocking signals ensure higher precision initial tuning and, if needed, rapid course tuning of the object visibility.

11 Claims, 3 Drawing Sheets

VARIABLE SPEED CONTROLLER FOR AN ELECTRONIC DISPLAY

BACKGROUND OF THE INVENTION

1. Field of the Invention

This invention relates to an electronic display and more particularly to a variable speed clocking circuit for controlling the display.

2. Background of the Relevant Art

Electronic displays are well known in the art. As used herein, "electronic display" represents any electronically controlled terminal or monitor for displaying graphic and/or alphanumeric symbols. Electronic display includes any active or passive display device. Active devices include displays utilizing the various light-emitting processes such as, for example, cathodoluminescence, photoluminescence, electroluminescence, plasma decay and blackbody radiation. Cathodoluminescence includes cathode ray tubes (CRTs), photoluminescence includes colored gas discharge devices and fluorescent lamps, and electroluminescent devices include light-emitting diodes (LEDs). Plasma decay and blackbody radiation techniques are typically used in gas discharge panels and tungsten filament projection devices, respectively. Passive displays include displays controlled by light-absorption or light-reflection processes. Passive displays include electromechanical, electrochromeric, electropolarization and electrophoretic display techniques. The most popular passive display, utilizing electropolarization, includes liquid crystal displays (LCDs).

Electronic displays can present an object (alphanumeric character or graphic depiction) using various font geometries. For example, a CRT typically utilizes a large array of pixels arranged across the entire display area. One or more pixels may become illuminated to register a portion of the desired object. Thus, CRTs are often used to present alphanumeric or graphic objects. Passive displays, such as LCDs, often utilize seven or ten segment fonts. Instead of having an array of pixels arranged across the entire screen area, segments are arranged on a portion of the screen area. When one or more segments are illuminated, a corresponding alphanumeric symbol is formed. Various types of fonts become suitable depending upon the display technology chosen.

Regardless of the display technology chosen or the font being displayed, electronic displays are generally adjustable to suit human perception. The object can be moved horizontally or vertically by actuating one or more buttons arranged on the display housing. The viewing range, either horizontal or vertical range, may also be expanded or contracted to suit the viewer. Still further, many displays have switches which can vary the "visibility" of the object being displayed. "Visibility" is defined herein as quantifiable factors used to define ease by which the user perceives the object. There are two quantities which define visibility: display contrast and brightness.

Many conventional displays incorporate a memory which will store the desired optimal object position and viewing range after they have been set. Each time the display is thereafter turned on, the display position and field of view will be addressed from memory and fixed at the set position upon the screen. However, optimal visibility cannot easily be set and retrieved from memory. Visibility is a subjective standard which varies from user-to-user or from setting-to-setting. What might be perceived as an optimal contrast and brightness setting for one user is not optimal for another user. Furthermore, periodic changes to brightness and contrast may be needed depending upon whether the display is used in a bright or dark room. Sunlit rooms may require a larger contrast ratio in order to make the object more discernable from the display background. Due to necessity, visibility must thereby be left readily variable in order for each user to "tune" the setting to fit the particular surrounding or user's liking.

Light-emitting displays such as LEDs, plasma, CRTs, and vacuum fluorescent display measure luminance as the number of foot-lambert emitted. The amount of emission is termed luminance, and luminance varies across the display depending upon whether emission is from the object or from the background. The psychological interpretation of luminance is often termed "brightness". Brightness for a passive (non-light emitting display) is usually represented as a percentage of the brightness of a standard white material. Passive displays will reflect or absorb different amounts of light back to the eye (or photometer). For example, a display having no print will reflect a percentage of standard white. The printed portion will reflect a lesser percentage of standard white. The amount of reflection determines the amount of brightness (as perceived by the eye). The difference between the reflected background and the reflected printed portion can therefore be quantified in terms of a contrast ratio.

The contrast ratio is generally considered one of the most important visual characteristic of a display. The sole function of a display is to convey information by modifying an array of pixels or segments upon a screen. The contrast ratio indicates the amount of difference between a pixel or segment within an illuminated object area and a pixel or segment within the display background. The contrast ratio is thereby used to discriminate between, for example, a pixel that is fully on and a pixel that is fully off. Contrast ratio is often defined in simple terms as follows:

$$\text{Contrast Ratio} = \frac{\text{Luminance of "on" area (object)}}{\text{Luminance of "off" area (background)}}$$

Luminance is often defined in terms of the amount of luminance per square area, or lux. Thus, contrast ratio is determined by measuring the ratio of the on luminance and off luminance per square area. Luminance of the on area is defined as that area through which light is emitted (active displays) or that area through which light is reflected or absorbed (passive displays).

As mentioned above, numerous visibility settings (contrast and brightness) may be required each time the display is used. In most cases visibility need only be changed slightly in order to take into account slight changes in human perception and relatively slight changes in surrounding lumination. However, if visibility must be drastically changed, it is important that it can be quickly changed with precision to the exact, optimal setting.

SUMMARY OF THE INVENTION

Many problems associated with accurate and precise adjustment of a display's visibility are solved by the present invention. That is, the electronic display and electronic display controller of the present invention allows the user to quickly and accurately adjust the display's visibility parameters. Visibility of the displayed object can be quickly and accurately changed to a new user's liking by actuating a button or switch on the outer housing of the display. Initial actuation of the button will fine tune visibility, while prolonged actuation will speed up visibility adjustment.

Visibility adjustment is achieved by using a variable speed clocking circuit coupled to an electronically controlled potentiometer associated with the display power supply. The clocking circuit is activated by pressing the button or switch on the display housing. Once activated, the clocking circuit forwards a clocking signal at a first clocking frequency to the potentiometer. Each clocking pulse causes incremental changes in the potentiometer output thereby incrementally increasing or decreasing the brightness of the display object, the display background or both. A subsequent, higher frequency, clocking frequency of the clocking signal can be sent to the potentiometer if the user continues pressing the visibility adjustment button or switch. The higher frequency pulses will cause faster incrementation of the potentiometer thereby providing a faster (or courser) adjustment of visibility. Accordingly, pressing the button a set period of time will cause slower/fine visibility adjustment to occur for a first portion of the set period and a faster/course visibility adjustment to subsequently occur for a second portion of the set period. If the user activates the button too long and overshoots the desired object visibility setting, then he or she can activate a reverse button causing visibility settings to first decrement in fine tuning amounts, and then, if the reverse button remains active, decrement in course tuning amounts. Thus, course and fine tuning steps can be incremented (e.g., contrast and brightness increased) or decremented (e.g., contrast and brightness decreased).

Broadly speaking, the present invention contemplates an electronic display controller comprising a potentiometer capable of producing an incremental change in voltage output to an electronic display in response to a clocking signal. A clocking circuit is capable of producing the clocking signal at a variable frequency, and a switch can be activated for initiating the clocking circuit. The clocking circuit includes a bistable circuit responsive to a triggering input from the switch, and a power supply and ground supply coupled to the circuit. A discharge path can be coupled between the ground supply and the triggering input. A first charge path of a first resistance can be coupled between the power supply and the triggering input, while a second charge path of a second resistance can be coupled between the power supply and the triggering input. The first charge path can be coupled for a first time period and the discharge path can be coupled for a second time period, wherein the second time period occurs different from the first time period. The second charge path can be coupled for a third time period and the discharge path can be coupled for a fourth time period, wherein the fourth time period occurs different from the third time period. The first and second time periods are cycled therebetween, the third and fourth time periods are cycled therebetween, and the first and second time periods occur prior to the third and fourth time periods.

The present invention further contemplates an electronic display. The display includes an outer surface and a power source contained with the outer surface. A clocking circuit is capable of producing an initial plurality of relatively low frequency clocking cycles and a subsequent plurality of relatively high frequency clocking cycles when the clocking circuit is active. The display includes a potentiometer having an input and an output, the input is coupled to receive the clocking cycles from the clocking circuit and the output is connected to the power source. A switch is mounted to the outer surface for activating the clocking circuit and for incrementally varying the potentiometer output in response to the clocking cycle. Activating the switch causes a series of low frequency clocking cycles to be sent to the potentiometer thereby slowly increasing the amount of voltage sent from the potentiometer to the electronic display. If the switch remains active for a prolonged period of time, the clocking circuit will begin producing a plurality of relatively high frequency clocking cycles sent to the potentiometer thereby more quickly increasing the amount of voltage sent from the potentiometer to the electronic display. The potentiometer can thereby slowly adjust (fine tune) the visibility settings associated with power source output. If the visibility switch remains set after a fine tuning period has elapsed, then the potentiometer can quickly adjust (course tune) the visibility settings associated with power source output. Each time a pulse is received by the potentiometer, the power produced by the display is incrementally adjusted upward or downward depending upon whether the up or down visibility switch (e.g., contrast and brightness switch) is active. Increasing the clocking frequency will thereby increase or decrease contrast and brightness settings from fine to course incremental amounts.

BRIEF DESCRIPTION OF THE DRAWINGS

Other objects and advantages of the present invention will become apparent upon reading the following detailed description and upon reference to the accompanying drawings in which.

Figure 1:
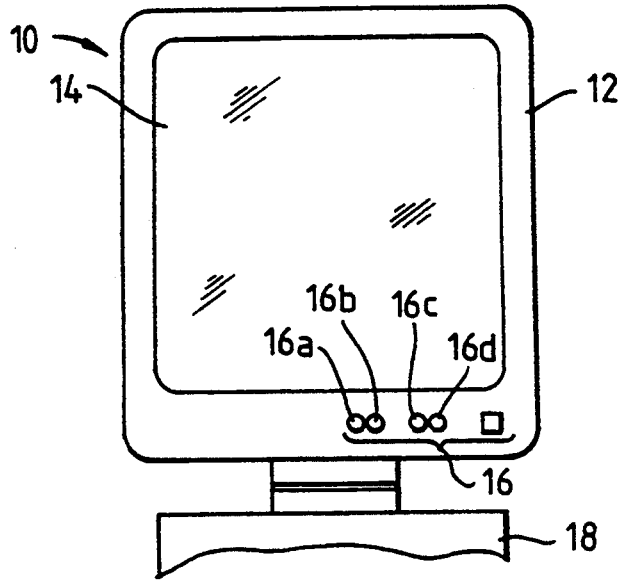
FIG. 1 is an elevational view of an electronic display according to the present invention.

While the invention is susceptible to various modifications and alternative forms, specific embodiments thereof are shown by way of example in the drawings and will herein be described in detail. It should be understood, however, that the drawings and description thereto are not intended to limit the invention to the particular forms disclosed, but on the contrary, the intention is to cover all modifications, equivalents and alternatives falling within the spirit and scope of the present invention as defined by the appended claims.

DETAILED DESCRIPTION OF THE INVENTION

Turning now to the drawings, FIG. 1 illustrates an electronic display 10 according to the present invention. Display 10 includes an outer housing 12 and a viewing window or screen 14. Objects, either graphic or alphanumeric, can be displayed across at least a portion of screen 14 during times in which display 10 is active. Mounted on housing 12 are a series of switches or buttons 16. Buttons 16 are of common design and can be depressed to turn on display 10, adjust the position of the object, and vary the vertical and horizontal range of view. Still further, buttons 16 include visibility buttons which can be used to increase and/or decrease brightness and contrast. A pair of buttons **16*a* and 16*b* can be used, for example, to respectively increase and decrease brightness. Another pair of buttons 16*c* and 16*d* can be used, for example, to respectively increase and decrease contrast. Display 10 is thereby used to depict any analog or digital information received over a conductor or data bus connected between display 10 and a host electronic device 18**.

Figure 2:
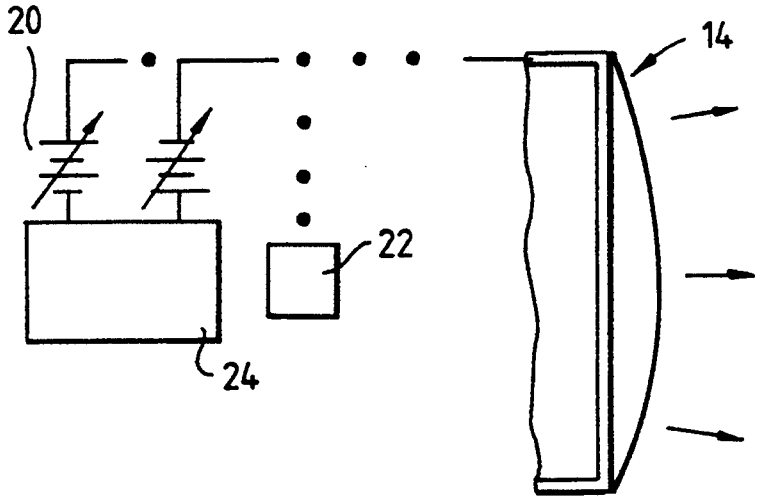
FIG. 2 is a plan view of an electronic display and variable power source according to the present invention.

Turning now to FIG. 2, a plan view of an electronic display is shown including screen 14 and a variable power source 20. Source 20 is used to output a variable power amount. The power can be either positive or negative polarity voltage. The variable voltage can be used to power either an active or a passive display device. For example, variable voltage can be placed between an anode 22 and a cathode 24 to produce variable power necessary to adjust visibility of an active, light-emission display device. Conversely, variable source 20 can be coupled between glass plates and selectively across transparent electrodes in order to adjust visibility of a passive, light-reflective or light-absorbing display device (e.g., reflective LCD display).

Figure 3:
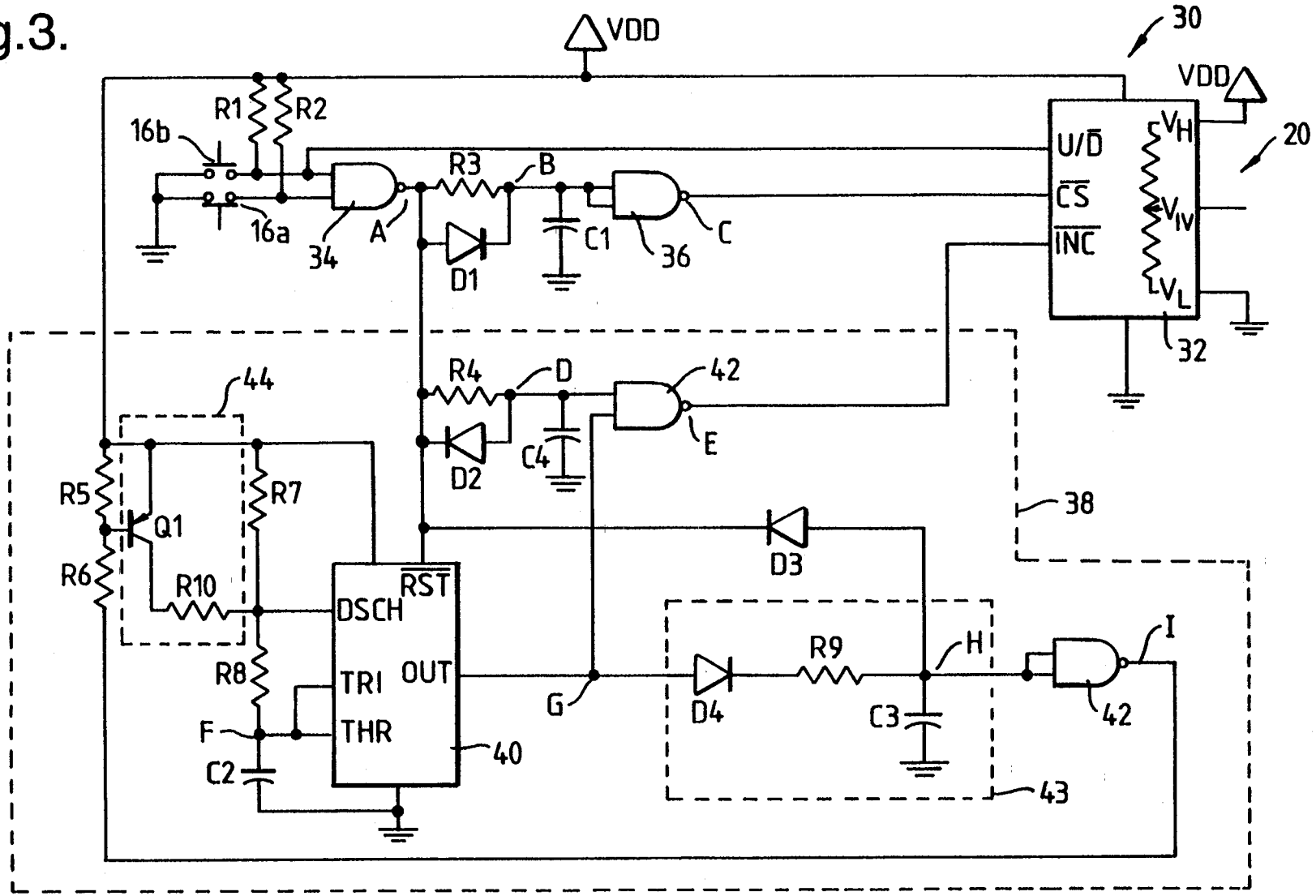
FIG. 3 is a circuit diagram of an electronic display controller according to the present invention.

Referring now to FIG. 3, variable power (or variable resistance) source 20 is achieved at the output of an electronic display controller 30. Display controller 30 includes a potentiometer 32 having a resistance value which can be changed by moving a contact, $V_w$, or wiper along its resistive element to choose a designed output resistance value. Potentiometer 32 includes two terminals, a high and a low voltage terminal ($V_H$ and $V_L$, respectively). The minimum and maximum high and low voltages applied to the terminals is determined by the voltage on the power supply pin VDD. The wiper terminal has an associated voltage $V_W$ equivalent to a moveable terminal ranging between $V_L$ and $V_H$. The direction in which wiper voltage $V_W$ moves, either toward $V_H$ or toward $V_L$, is dependent upon the logic state at input pin $U/\overline{D}$. If, for example $U/\overline{D}$ receives a relatively high voltage, then $V_W$ will move toward $V_H$. Conversely, if $U/\overline{D}$ receives a relatively low voltage, then $V_W$ will move toward $V_L$. Movement of $V_W$ is incrementally actuated by clocking signals sent to INC bar. INC bar input is negative edge-triggered. Toggling INC bar will move $V_W$ and either increment or decrement an internal counter within potentiometer 32 in the direction indicated by the logic level on the $U/\overline{D}$ input. Position of the wiper and associated $V_W$ voltage can therefore be stored in non-volatile memory and then be recalled on a subsequent power-on operation. Potentiometer 32 is activated to change potentiometer setting only when power is applied, or when the CS bar input is low. The current counter value received at INC bar input is stored in non-volatile memory when CS bar is returned high, while the INC bar is also high.

Potentiometers are fairly common in the art. A suitable potentiometer can be obtained from Xicor, Corp. of Milipitas, Calif., part no. X9CMME. $V_W$ output from potentiometer 32 is used to control the power source associated with display 10. As described above, variable power source 20 can be connected to either an active or passive display.

It is important to note that FIG. 3 illustrates a circuit diagram necessary to control one visibility parameter such as, e.g., contrast. It is understood that several visibility parameters can be controlled, each by a circuit shown in FIG. 3. Thus, another control circuit is needed to control another visibility parameters such as, e.g., brightness. Accordingly, two electronic display controllers may be needed to provide visibility adjustment and to accommodate both brightness (both up and down buttons) and contrast (both up and down buttons).

Shown in FIG. 3 are a pair of buttons or switches. Exemplary buttons might be buttons necessary to control brightness up and down settings, e.g., **16*a* and 16*b*. If neither switch 16*a* or 16*b* are activated, resistors R1 and R2 will pull-up the inputs to nand gate 34 causing a relatively low voltage at the input to nand gate 36. A resulting high voltage will then be presented to CS bar thereby deselecting potentiometer 32. If one of the buttons is depressed (for example button 16*b*), then nand gate 34 will receive a low input thereby driving a logic high voltage at the input of nand gate 36. A resulting low voltage is thereby presented to CS bar necessary to select potentiometer 32. Once potentiometer 32 is selected, it is capable of receiving clocking signals from a clocking circuit 38. Clocking circuit 38 presents a series of pulses of variable pulse period or frequency to the input INC bar. If, for example, button 16*b* is depressed, $U/\overline{D}$ input will be relatively low denoting decremental adjustment to voltage whenever INC bar receives a clocking pulse. Conversely, whenever button 16*b* is not depressed and button 16*a*** is depressed, then pulse signals at INC bar input will increase the voltage at $V_W$.

Switch **16*a* and 16*b* includes a pair of pull-up resistors R1 and R2, nand gates 34 and 36, bypass diode D1 and resistor-capacitor network R3 and C1. Resistor R3 is substantially larger than resistors R1 and R2, and capacitor C1 is fairly small, a suitable size being approximately 0.001 $\mu$f. Resistor capacitor network R3 and C1 operate as a low-pass filter and produce a time delay required by potentiometer 32 when the signal at the output of nand gate 34 switches from a logic one to a logic zero. When nand gate 34 output switches from logic zero to logic one, diode D1 turns on and quickly charges capacitor C1. A fast charging capacitor C1 allows the output of nand gate 36 to become active low before the output of nand gate 42** goes active low.

Clocking circuit 38 includes a bistable circuit 40 which functions similar to an RS flip flop with external toggling inputs driven by two voltage comparators 50. Circuit 40 is selected when reset bar (RST bar) input receives a logic high voltage. Not only does a high voltage at RST bar enable circuit 40, but it also reverse biases diode D3 thereby allowing voltage increase at the input of nand gate 42 and, after sufficient charging of C3, allowing nand gate 42 to switch to a voltage state dependent upon the voltage level developed at its input. Thus, a high output from nand gate 34 ensures clocking circuit 38 becomes operable. Once output from nand gate 34 goes low, diode D2 becomes forward biased and clocking circuit 38 ceases output operation at the same time nand gate 36 output is delayed via R3 and C1—a requirement of potentiometer 32 in storing the value of the potentiometer setting.

Circuit 40 includes an output signal which clocks at pulse frequencies dependent upon the voltage states at input trigger pin (TRI) and threshold pin (THR). If, for example, TRI and THR are below $\frac{1}{3}$ VDD, then OUT voltage will be high. Conversely, if TRI and THR are greater than $\frac{2}{3}$ VDD, then OUT voltage will be low. The voltages at TRI and THR are modulated by the activation of discharge pin (DSCH). Once TRI and THR go above $\frac{2}{3}$ VDD, then discharge switch turns on causing DSCH to discharge voltage on C2 to ground. Charge on TRI and THR will be decreased via DSCH until TRI and THR go below $\frac{1}{3}$ VDD, at which time discharge switch is disabled and DSCH no longer sinks current to ground. At this time, TRI and THR will charge back up to a high level ($\frac{2}{3}$ VDD) via C2 thereby repeated the charge and discharge cycle. Circuit 40 includes any bistable circuit having set and reset capabilities necessary for producing a monolithic timing circuit. A suitable circuit 40 can be obtained from Texas Instruments, Inc., Dallas, Tex., part no. TLC556.

While the voltages at TRI and THR discharge through DSCH pin to ground, the voltages can be charged in either of two ways. Depending upon the voltage state at the output of nand gate 42, TRI and THR will charge from a second conductive path 44 through resistor R10 or from a first conductive path through resistor R7. Resistor R7 is purposefully made much larger in value than resistor R10. Suitable resistor values for R7 is 100KΩ and for R10 is approximately 10KΩ to allow a considerable ratio therebetween. Differences in resistance, when coupled to capacitor C2, allows the chosen resistor-capacitor path to charge at varying rates depending upon which resistor is chosen. If, for example, resistor R7 is selected, then TRI and THR will charge slower than if resistor R10 is selected. Thus, faster or slower charge of TRI and THR allows for faster or slower frequency output from circuit 40 to nand gate 42.

Figure 4A:
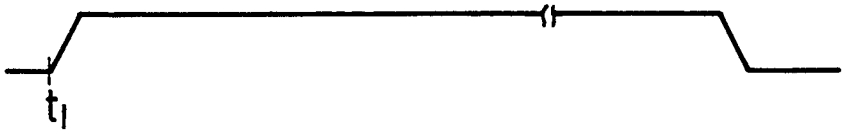
FIGS. 4*a*–4*i* are timing diagrams of respective voltage levels appearing at various points in the electronic display controller according to the present invention.
Figure 4B:
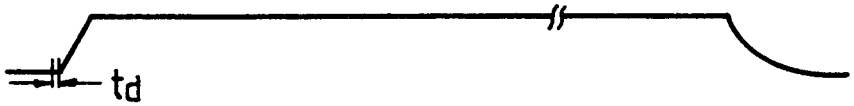
Figure 4C:
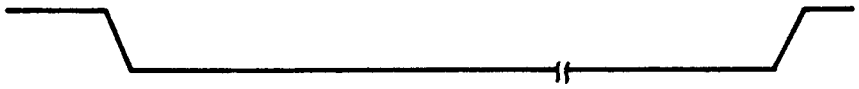
Figure 4D:
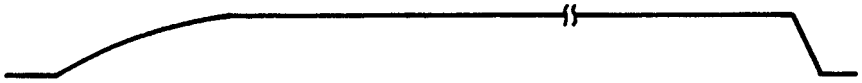
Figure 4E:
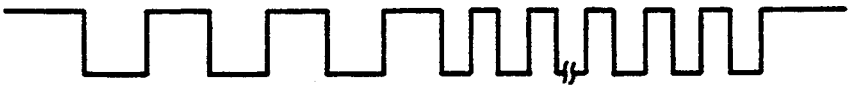

Referring now to FIGS. 4*a*–4*i*, the operation of display controller 30 will be described in more detail. Specifically, FIGS. 4*a*–4*i* are timing diagrams of various voltage levels appearing at points A through I shown on FIG. 3. Prior to buttons 16*a* or 16*b* being active, node A, shown in FIG. 4*a*, is low as well as node B, shown in FIG. 4*b*. Node C will result in a high voltage, as shown in FIG. 4*c*, to disable changing value of potentiometer 32. Since node A is low, node D, shown in FIG. 4*d*, will be low and RST bar will be low causing a low output at node G, shown in FIG. 4*g*. Regardless of the voltage at node G, node D, being low, will always ensure a high output from nand gate 42 and that nand gate 42 will not toggle.

Activation of either button 16*a* or 16*b* will cause node A to slew toward a high level voltage at time $t_1$. Once node A goes high, then node B will go high after a certain delay period $t_d$ (depending upon the value of the on resistance of diode D1 and capacitor C1). Node C will correspondingly go low thereby enabling potentiometer 32. Logic high voltage at node A will also cause a slow increase in voltage at node D dictated by the value of resistor R4 and capacitor C4 (i.e., diode D2 being reverse biased at this time). Once node D goes high, clocking signals at node G will toggle nand gate 42 and increment or decrement voltage $V_W$ of potentiometer 32.

Figure 4F:
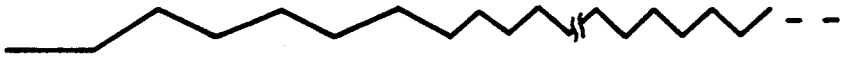

As described above, high voltage at RST bar input allows OUT to toggle between a high and low state depending upon the values of C2, R8, R7 and R10. The charging and discharging of TRI and THR at node F is shown in FIG. 4*f*. Node F is charged toward a $\frac{2}{3}$ VDD level via a conductive path between VDD and VSS, and through resistors R7, R8, and capacitor C2. Thereafter, capacitor C2 is discharged through DSCH to ground via resistor R8 once TRI and THR achieve a $\frac{2}{3}$ VDD voltage. The charging and discharging of capacitor C2 at node F is repeated provided RST bar remains high. If buttons 16*a* or 16*b* remain depressed after a set period of time, the voltage at node G will eventually charge node H via resistor R9 and capacitor C3 to a relatively high value and forcing output of nand gate 42 to a low level at node I. Voltage state at nodes H and I are shown, respectively, in FIGS. 4*h* and 4*i*.

Once node I goes low, then secondary charge path 44 becomes active. The first charge path through resistor R7 is always active any time DSCH is not active low. Secondary charge path is activated due to transistor Q1 being turned on when node I equals a low logic voltage. Q1 does not turn on until current is drawn via resistor R6 to ground when node I is low. Resistor-divider network R5 and R6 ensures that bipolar transistor Q1 remains on when node I is low and off when node I is high. Second charge path 44 includes the on resistance of transistor Q1 and resistor R10, in parallel with resistor R7. Preferably, resistor R7 is several times greater than on resistance Q1 and resistor R10. The higher frequency clocking cycles have a rise time substantially equal to (R7+R8)C2, and a discharge time substantially equal to R8*C2. Likewise the lower frequency clocking cycles have a rise time of approximately {[(R10*R7)/(R10+R7)]+R8}*C2, and a discharge time approximately equal to R8*C2.

Figure 4G:
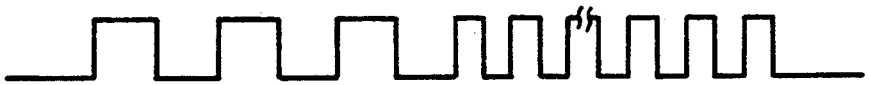
Figure 4H:
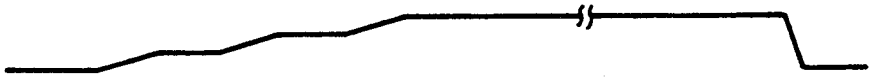
Figure 4I:
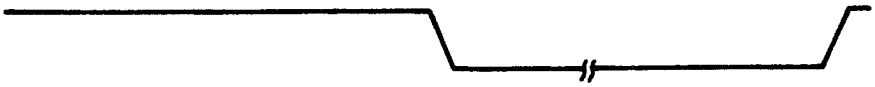

By activating second (or secondary) charge path 44, TRI and THR can be charged at a much faster rate as shown in FIG. 4*f*. Faster charge rates translate into higher frequency output from circuit 40 at node G as shown in FIG. 4*g*. Accordingly, node E also toggles at a higher frequency causing potentiometer 32 to become incremented or decremented at a faster rate. As shown in FIG. 3, circuit 43 is driven by the voltage state at node G. When node G is a logic high voltage, then diode D4 is forward biased allowing capacitor C3 to charge via resistor R9. When node G goes to a logic low level, diode D4 turns off allowing the charge on capacitor C3 to retain its charge. When node G goes to a high logic state again, diode D4 turns on again allowing C3 to charge again (to a high level). Circuit 43 allows relatively long charge time using a lower cost configuration (i.e., low cost capacitor C3).

Accordingly, it is appreciated from the present invention that display controller 30 can be used for any visibility display adjustment and can increment adjustment in power supply at varying rates or frequencies. Initially, power supply 20 is incremented or decremented slowly (i.e., at a slower input clocking frequency). If button 16 remains active after a set period of time, then power supply is incremented or decremented at a much faster rate (i.e., at a faster input clocking frequency). Thus, the user can slowly increment (fine tune) visibility setting from one value to another value during the initial stages of visibility change. In most cases, only small changes need be made since user preference generally varies only slightly. Accordingly, most changes can be made with higher precision fine tuning. If user preference dictates course tuning, then the user need only maintain constant button activation in order to increase the rate of visibility adjustment. The amount of fine tuning prior to course tuning can be varied depending upon the values chosen for resistor R9 and capacitor C3. In the preferred example shown, a suitable resistor and capacitor values for resistor R9 and capacitor C3 are 100KΩ and 0.001 μf, respectively. Increase in resistance in resistor or capacitor values will provide a longer fine tune time prior to course tuning. Conversely, if resistor R9 and capacitor C3 are decreased, then fine tuning time period will decrease thereby allowing more time, if necessary, for course tuning.

Figure 5:
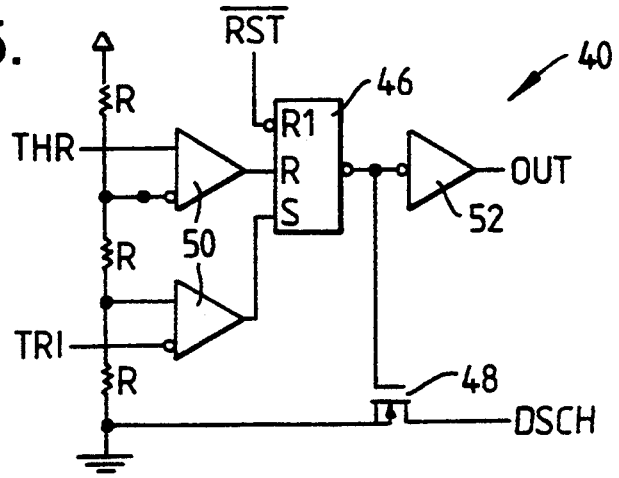
FIG. 5 is a circuit diagram of a portion of a clocking circuit according to the present invention.

Turning now to FIG. 5, bistable circuit 40 is illustrated. Circuit 40 includes an RS flip flop 46, n-channel FET device 48, a pair of voltage comparators 50, a resistor divider network, and an inverter/buffer output device 52. Voltages sensed on TRI and THR input control the voltage level at OUT. THR and TRI are connected together (see FIG. 3) and the voltage levels at TRI and THR are modulated by the voltage at DSCH. When node F exceeds $\frac{2}{3}$ VDD, the RS flip flop is reset and when node F is less than $\frac{1}{3}$ VDD, the RS flip flop is set.

It will be appreciated to those skilled in the art having the benefit of this disclosure that this invention is believed to be capable of applications with numerous types of electronic displays, either active or passive displays, and other load circuits or devices which require wide range of control with initial fine and subsequent course control resolution. Furthermore, it is also to be understood that the form of the invention shown and described is to be taken as a presently preferred embodiment. Various modifications and changes may be made without departing from the spirit and scope of the invention as set forth in the claims. Exemplary modifications might include various changes in resistor or capacitor values as well as changes to the internal circuitry of circuit 40 and potentiometer 32. Provided circuit 40 and potentiometer 32 present a variable voltage output in response to a variable clocking circuit output, any modifications whatsoever to internal circuit characteristics can be made and still fall within the spirit and scope of the invention. It is intended that the following claims be interpreted to embrace all such modifications and changes.

What is claimed is:

1. An electronic display controller comprising:

a potentiometer capable of producing an incremental change in voltage output to an electronic display in response to a clocking signal;

a clocking circuit capable of producing said clocking signal with a series of transitions occurring at an initial low frequency and at a subsequent higher frequency, wherein said clocking circuit comprises:

an bistable circuit responsive to a triggering input;

a power supply and a ground supply;

a discharge path capable of being coupled between said ground supply and said triggering input;

a first charge path of a first resistance capable of being coupled between said power supply and said triggering input;

a second charge path of a second resistance capable of being coupled between said power supply and said triggering input;

means for coupling said first charge path for a first time period and for coupling said discharge path for a second time period, wherein said second time period is dissimilar to said first time period;

means for coupling said second charge path for a third time period and for coupling said discharge path for a fourth time period, wherein said fourth time period is dissimilar to said third time period; and switch means for activating said clocking circuit.

2. The display controller as recited in claim 1, wherein said first time period and said second time period are cycled therebetween, and said first and second time period occur prior to said third and fourth time period.

3. The display controller as recited in claim 1, wherein said first resistance is more than said second resistance.

4. The display controller as recited in claim 1, wherein said first charge path and said second charge path include a capacitor coupled between said triggering input and said ground supply.

5. An electronic display comprising:

a display having an outer surface and a power source;

a clocking circuit capable of producing an initial plurality of relatively low frequency clocking cycles and a subsequent plurality of relatively high frequency clocking cycles when said clocking circuit is active, wherein said clocking circuit comprises:

an bistable circuit responsive to a triggering input;

a power supply and a ground supply;

a discharge path capable of being coupled between said ground supply and said triggering input;

a first charge path of a first resistance capable of being coupled between said power supply and said triggering/threshold input;

a second charge path of a second resistance capable of being coupled between said power supply and said triggering/threshold input;

means for coupling said first charge path for a first time period and for coupling said discharge path for a second time period, wherein said first and second time periods occur at dissimilar times and are cycled therebetween to form said relatively low frequency clocking cycles;

means for coupling said second charge path for a third time period and for coupling said discharge path for a fourth time period, wherein said third and fourth time periods occur at dissimilar times and are cycled therebetween to form said relatively high frequency clocking cycles;

a potentiometer having an input and an output, said input is coupled to receive said clocking cycles from said clocking circuit and said output is connected to said power source; and switch means mounted to said outer surface for activating said clocking circuit and for incrementally varying said potentiometer output in response to each said clocking cycle.

6. The display as recited in claim 5, wherein said first resistance is more than said second resistance.

7. The display controller as recited in claim 5, wherein said first charge path and said second charge path include a capacitor coupled between said triggering input and said ground supply.

8. An electronic display comprising:

a visual display having an outer surface and a power source contained within said outer surface;

a clocking circuit including:

an oscillating circuit responsive to a trigger input;

a power supply and a ground supply;

a discharge path capable of being coupled between said ground supply and said triggering input;

a first charge path of a first resistance capable of being coupled between said power supply and said triggering input;

a second charge path of a second resistance capable of being coupled between said power supply and said triggering input;

means for coupling said first charge path for a first time period and for coupling said discharge path for a second time period, wherein said first and second time periods occur at dissimilar times and are cycled therebetween to form a plurality of relatively low frequency clocking cycles;

means for coupling said second charge path for a third time period and for coupling said discharge path for a fourth time period, wherein said third and fourth time periods occur at dissimilar times and are cycled therebetween to form a plurality of relatively high frequency clocking cycles;

a potentiometer having an input and an output, said input is coupled to receive said clocking cycles from said clocking circuit and said output is connected to said power source; and switch means mounted to said outer surface for producing said trigger input and thereby causing said clocking cycles to incrementally vary said potentiometer output in response to each said clocking cycle.

9. The display as recited in claim 8, wherein said first resistance is more than said second resistance.

10. The display as recited in claim 8, wherein said switch means comprises:

a power supply and a ground supply;

a two input nand gate having an output coupled to said clocking circuit;

an up switch coupled between said ground supply and one input of said two input nand gate;

a down switch coupled between said ground supply and the other input of said two input nand gate; and a pull-up resistor connected between said power supply and each input of said two input nand gate.

11. The display as recited in claim 10, wherein said one input of said two input nand gate is connected to an up/down selecting input of said potentiometer.

* * * * *